United States Patent [19]

Bauer et al.

[11] Patent Number: 4,734,165

[45] Date of Patent: Mar. 29, 1988

[54] METHOD FOR THE PRODUCTION OF COKE

[75] Inventors: Hartmut Bauer; Dietrich Wagener, both of Essen; Egmar Wunderlich, Mülheim/Redes, all of Fed. Rep. of Germany

[73] Assignee: Didier Engineering GmbH, Essen, Fed. Rep. of Germany

[21] Appl. No.: 860,218

[22] Filed: May 6, 1986

[30] Foreign Application Priority Data

May 6, 1985 [DE] Fed. Rep. of Germany ..... 3516225
May 6, 1985 [DE] Fed. Rep. of Germany ..... 3516226
May 6, 1985 [DE] Fed. Rep. of Germany ..... 3516227

[51] Int. Cl.[4] ..... C10B 51/00

[52] U.S. Cl. ..... 201/44; 201/26; 201/36; 201/43; 202/108

[58] Field of Search ..... 201/14, 26, 29, 35, 201/36, 41, 43, 44, 9; 202/99, 108, 109, 110, 113

[56] References Cited

U.S. PATENT DOCUMENTS

| | | | |
|---|---|---|---|
| Re. 20,392 | 6/1937 | Karrick | 201/26 |
| 1,548,964 | 6/1923 | Baille-Barrelle | 201/41 |
| 1,838,883 | 12/1931 | Trent | 201/14 |
| 1,954,351 | 4/1934 | Dornbrook et al. | 201/9 |
| 2,658,862 | 11/1953 | Horner | 202/105 |
| 3,398,058 | 8/1968 | Campbell | 201/15 |
| 3,970,523 | 7/1976 | Beck et al. | 201/41 |
| 4,421,604 | 12/1983 | Weskamp et al. | 201/44 |

FOREIGN PATENT DOCUMENTS

| | | | |
|---|---|---|---|
| 808309 | 2/1937 | France . | |
| 307097 | 8/1971 | U.S.S.R. | 201/44 |

*Primary Examiner*—Barry S. Richman
*Assistant Examiner*—Joye L. Woodard
*Attorney, Agent, or Firm*—Wenderoth, Lind & Ponack

[57] ABSTRACT

Coke is produced from coal by coking the coal, and optionally by drying and/or preheating the coal prior to coking, and further optionally by dry cooling the coke subsequent to coking. At least the coking step is achieved in a pressure tight container which may be a transportable or tippable container. The coking step is performed in the container by conducting a gas through the container in direct or indirect heat exchange relationship with the coal and forming coke. The coking step includes a phase of lump coke formation achieved by heating the coal in a temperature range of between approximately 250° and 600° C. by indirect heat exchange only.

15 Claims, 2 Drawing Figures

METHOD FOR THE PRODUCTION OF COKE

BACKGROUND OF THE INVENTION

The present invention relates to the production of coke from coal by coking the coal, and optionally by drying and/or preheating the coal prior to coking, and further optionally by dry cooling the coke subsequent to coking.

In the past, coke was produced in a manner such that coal was first dried, if added as wet coal, and preheated in a container. The preheated coal was then filled into one chamber of a chamber oven provided with a large number of parallel chambers spaced apart by relatively large distances, in which oven the coking temperature was reached by heating the chamber walls with suitable gases. The coking process was conducted at staggered times in adjacent chambers. After coking, the finished coke was discharged through side chamber doors, and optionally was cooled moist or dry in a special coke cooling installation. The production of coke by this previous method thus required a relatively expensive installation. Additionally, coking in batteries of chamber ovens made it difficult to adapt to different discharge requirements, since individual chambers must not be cooled, or energy is consumed in a nonproductive manner. This requirement of not being able to cool individual chambers also caused problems when repairs became necessary since it was necessary for personnel to enter a still very hot oven.

SUMMARY OF THE INVENTION

Accordingly, it is an object of the present invention to provide methods of producing coke from coal of the type generally indicated above, but which overcome the above and other prior art disadvantages.

It is a further object of the present invention to provide such methods which are more economical, both with regard to cost of equipment and installation, and also with regard to operation.

It is a yet further object of the present invention to provide such methods which are easily adaptable to particular discharge or production requirements, and also which make it easier and more convenient to conduct installation repairs.

An even further object of the present invention is to provide a container for use in such methods.

It is a yet still further object of the present invention to provide an installation for carrying out such methods.

These objects are achieved in accordance with the method of the present invention by performing at least the coking step, and optionally the drying and/or preheating and/or dry coke cooling steps in a pressure sealed container by conducting a gas, preferably an inert gas, through the container in heat exchange relationship with the coal. Such heat exchange may be direct and/or indirect except during a temperature range of between approximately 250° and 600° C., during which lump coal is formed and during which only indirect heat exchange must be employed. In accordance with these features of the present invention, the production of coke is considerably more economical than prior methods, since the coking operation does not occur in conventional chamber ovens by simply heating chamber walls which are spaced relatively far apart from one another, but rather occurs by introducing gases at appropriate temperatures into the interior of the container, where the gases either come into direct contact with the coal or coke or the gases are passed through conduits placed relatively close together through the container, thereby transferring heat indirectly to the coal or coke. It is possible to adapt heating economically to the progress of the coking operation, so that before and after the plastic phase, i.e. the lump coal formation phase, in which only indirect heat should be applied, either direct or indirect heating or both types at once may be employed, depending on what is advisable for the particular process stage, this also applying to the dry coke cooling step. Because the container is a pressure tight vessel, the coking process and possibly also the additional process stages can be performed at negative pressure or under more or less increased pressure without detriment to the particular proper type of heating employed.

By performing at least the coking step or operation in a pressure tight container, it is possible to achieve an increase of the throughput of the pure coking process. It is not possible to increase the pressure in known coking chamber ovens. In contrast to known methods, the present invention also makes it possible to perform, in addition to the coking operation, the other production steps, namely drying and/or preheating of the coal prior to the coking step and/or the dry coke cooling subsequent to the coking step, in one and the same container. Therefore, it is not necessary to transfer the coal or coke from one installation into another in order, for example, to be able to perform the drying, preheating, coking and dry coke cooling operations in a successive manner. The container can be relatively small, for example approximately the size and shape of a steel ladle. Depending upon the requirements of a particular production run, several individual containers of the same type can be used, such individual containers however being independent from each other, in contrast to a customary chamber oven. If the production demand is low, individual containers readily can be shut down.

Since one or more of the processing steps may be performed in a transportable or tippable container, it is possible to bring already produced and distilled or refined coke to a receiver position, for example a blast furnace, by direct use of the container itself. In other words, in accordance with this aspect of the present invention, the coking container itself functions as at least a portion of a transportation or conveying system for the finished distilled coke.

The method of the present invention particularly is economical when all of the method operations are performed in one and the same container. To further improve economy, the drying and/or preheating and/or coking and/or coke cooling operations are achieved by use of an inert gas which is conducted in a closed circuit of a high temperature reactor in which the inert gas is cooled or heated to temperatures required for performing the respective operations. This particularly reduces costs for setting up an installation and for operation thereof. High temperature reactors for generating hot inert gases are known and would be understood to one skilled in the art without further discussion or description thereof.

However, the inert gas also can be brought to a higher and/or lower temperature level by use of an additional device in the circuit behind the high temperature reactor and before introduction of the inert gas into the container for achieving the drying and/or preheating and/or coking and/or dry coke cooling operations. Such additional device can be, for example, an adjacent container of the same type in which a coking process of the same type is performed in another method step.

Helium preferably is employed as the inert gas in accordance with the present invention. However, it also is possible to employ as the inert gas a coal degassing or carbonization gas, for example from another container of the same type, for use in the drying and/or preheating and/or coking and/or dry coke cooling operations.

In accordance with an advantageous feature of the present invention, a plurality of containers of the same type can be connected in series, with the inert gas being passed in series through the plurality of containers in such a manner that the inert gas from at least one upstream container is employed as a processing gas for at least one downstream container.

The method of the present invention advantageously is performed in such a manner that the drying and/or preheating steps are achieved in the container by directly and/or indirectly heating the coal therein with inert gas to a temperature of between approximately 150° and 250° C., preferably approximately 200° C. Within this temperature range, the use of an inert gas makes it possible to employ direct or indirect heating, or a combination of the two. Such process is achieved, for example, as in a fluid bed drying or predrying operation.

During the formation of lump coke during the coke production operation, the coal must be as uneffected as possible by gas currents, particularly in the plastic phase which occurs in the temperature range of between approximately 250° C. and 600° C., depending on the type of coal and its size. Since there is no interstitial space in the coal charge through which the gas can pass, the coal to be formed into lump coke during this phase must be heated exclusively by indirect heat exchange. That is, in this plastic phase during the transition from coal to coke, there essentially are no spaces or voids within the material and thus there is no way for gas to flow through such material. The coal or coke during this phase therefore must be heated by indirect heat exchange.

Above the relatively critical temperature range up to approximately 600° C., it is possible in accordance with another feature of the present invention to heat the coal or coke for achieving refined coking in the container to a temperature between approximately 1100° and 1300° C., preferably approximately 1200° C., by means of the inert gas by direct and/or indirect heating.

Since the method of the present invention is performed in a pressure tight container, it is quite possible to perform the drying and/or preheating and/or coking and/or dry coke cooling operations in at least one container at elevated or reduced pressures.

An advantageous feature of the present invention is that the inert gas, after having been conducted through the container, can be recycled back into the process, if necessary after having been cleaned and/or cooled.

In accordance with the present invention, the finished distilled coke may be conducted, either cooled or uncooled, with the aid of the container itself which may be constructed, for example, as a transportable or tippable container, to a blast furnace or other receiver position, for example another container of the same type. In accordance with a particular feature of the present invention, it is possible to deliver the distilled refined coke, cooled or uncooled, directly from the container into the blast furnace or other receiver position, or alternatively onto a conveyor system which transfers the coke to the blast furnace or other receiver position. These operations may be achieved by tipping the container so that the coke is discharged through an upper filling opening therein, or alternatively by discharging the coke through a closable discharge opening in the bottom of the container.

In accordance with one feature of the present invention, a low cost installation is assured if the inert gas is introduced, if desired under increased pressure, into the container through inlet openings provided therein, for example adjacent the bottom of the wall of the container, and then is removed through outlet openings, for example in an upper portion of the container wall. This arrangement provides for direct heat exchange between the inert gas and the contents of the container. Alternatively, the inert gas may be introduced into the interior of the container through pipes which extend into or which can be lowered from above into the container, and the inert gas then is discharged through such pipes. This arrangement provides for indirect heat exchange between the inert gas and the contents of the container.

In accordance with a further aspect of the present invention, the container has a construction such that it is pressure tight, and particularly includes an upper coal filling opening and means for sealing such filling opening in a pressure tight manner. The container may include a lower outlet opening for discharging coal or coke and means for sealing such outlet opening in a pressure tight manner. The sealing means for the outlet opening and/or filling opening may be in the form of covers mounted for pivoting movement toward and away from the respective openings. Openings or pipes are provided for introducing into the container processing gases, particularly inert gas, to achieve direct and/or indirect heat exchange. The container preferably includes a metal, for example iron, outer shell and an inner refractory lining. The container itself can be used as a part of a system for transportation of the coal or coke, and specifically the container is constructed to be transportable and/or tippable. In accordance with an advantageous arrangement of the present invention, the container is located adjacent to a receiver position, for example adjacent to an upper filling opening of a blast furnace, or adjacent to a conveyor system for transferring the coal and/or coke to a blast furnace or other receiver position. Thus, the container may be tiltable or tippable in order to discharge finished refined coke through the upper fill opening of the container to the particular receiver position. In accordance with another arrangement however, the container has therein the lower outlet opening covered by a bottom cover which may be pivoted away from the lower outlet opening so that pretreated coal or refined coke can be discharged from the container to a receiver position or to a conveying system.

In accordance with a further aspect of the present invention, there is provided an installation for producing coke by the above methods and employing at least one pressure tight container of the above type, as well as means for transferring coal or coke from the container or containers to a receiver position. The container or containers can be transported individually to the receiver position, or alternatively are associated with a common conveyor system for transferring treated coal and/or coke to the receiver position. In accordance with one feature of this aspect of the present invention, the container or containers are mounted for transportation in succession to a plurality of predetermined stations, and processing gas is introduced by pipes or conduits at each such station for supplying to the respective container a respective processing gas for conducting a respective of the processing operations, i.e. drying, preheating, dry coke cooling, or combinations thereof. It is possible in this manner to supply any one of the stations either continuously or discontinuously with respective process gas from an appropriate generator or source while the containers are moved in succession through the respective treatment stations.

BRIEF DESCRIPTION OF THE DRAWINGS

Other objects, features, advantages and applications of the present invention will be apparent from the following detailed description of preferred embodiments thereof, with reference to the accompanying drawings, wherein.

DETAILED DESCRIPTION OF THE INVENTION

Figure 1:
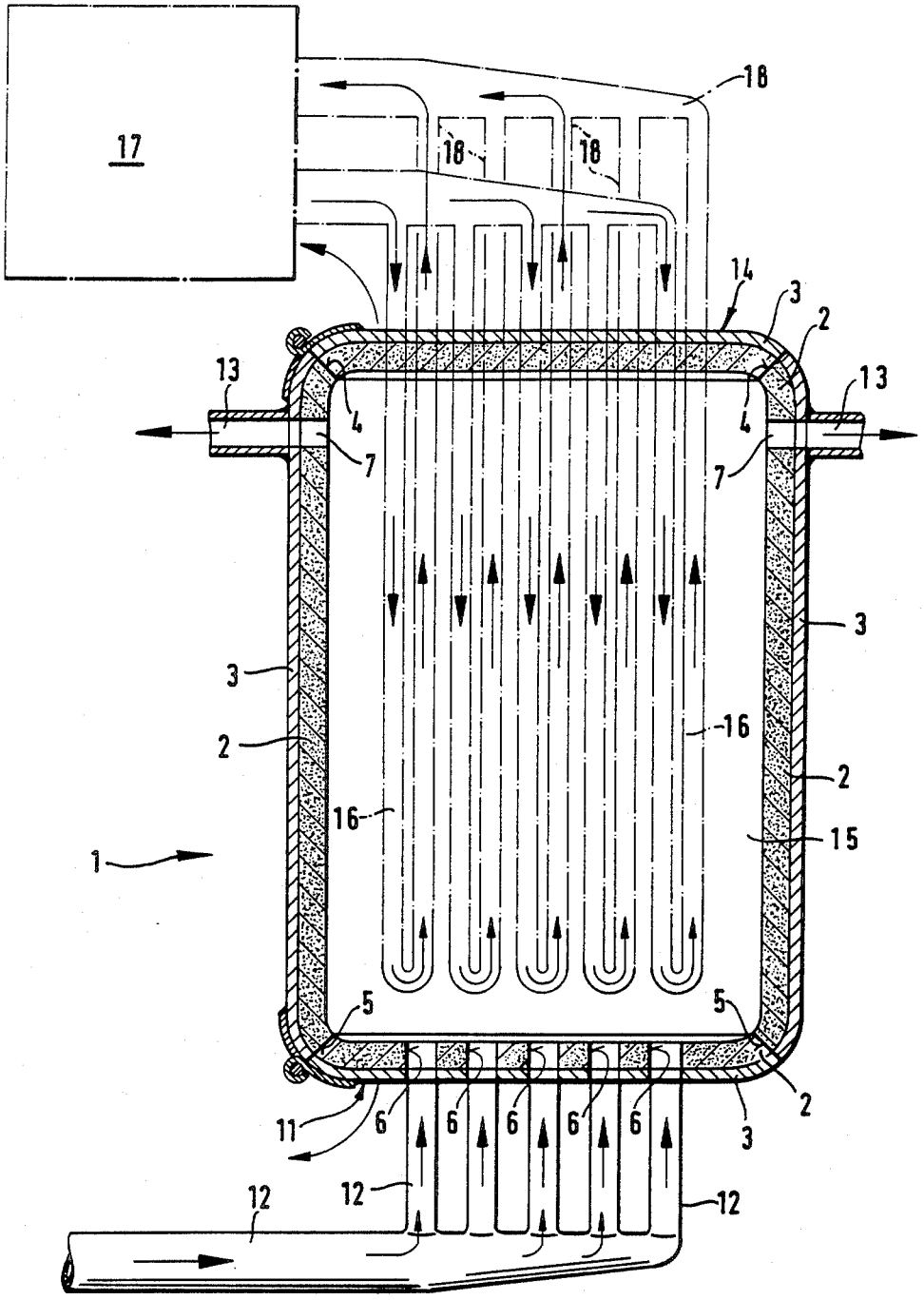
FIG. 1 is a schematic vertical section of a container according to the present invention for carrying out the methods of the invention.

In FIG. 1 is illustrated a container 1 for producing coke from coal by coking the coal, and optionally by drying and/or preheating of the coal prior to coking, and further optionally by dry cooling the coke subsequent to coking. Container 1 basically is in the form of a hollow cylinder and includes an outer metal shell 3, for example an iron shell, provided with an appropriate temperature-resistant and/or refractory lining 2, thereby forming walls of the container. The container has an upper fill opening 4 for supplying into the interior of the container coal or coke, which may already have been dried and/or preheated, and a lower outlet opening 5 for discharging from the container dried and/or preheated coal or finished refined distilled coke. Fill opening 4 and outlet opening 5 can be closed, preferably in a pressure tight manner, by means of pivotable cover 14 and pivotable bottom flap 11, of generally the same type construction as the walls of the container.

The gases required for the various processing operations, i.e. drying, preheating, coking and dry cooling, can be introduced into interior 15 of the container from lines 12 through openings 6, which in the illustrated embodiment are provided in bottom flap 11. This makes it possible for the coal or developing coke in interior 15 to be dried, preheated, coked or dry cooled in a successive manner in a single container. The various gases are conducted from the bottom upwardly through the contents within container interior 15 and leave the container interior via upper openings 7 which preferably are distributed evenly throughout the circumference of the side wall of the container and then via lines 13. It will be understood that lines 12 are connected to particular gas sources required for each of the various above processing steps. It will be apparent that the gas then comes into direct heat exchange relationship with the contents of the container interior.

Instead of introducing the various processing gases via lines 12 and openings 6 in bottom flap 11, the gases required for the particular processing steps, particularly for indirect heating and/or cooling of the coal or coke, can be introduced from above via pipes 18 connected to pipes 16 formed in a serpentine manner similar to a heat exchanger and which extend into the lower part of container interior 15. Pipes 16 can be lowered, for example, with cover 14 by relative movement of the cover with respect to the remainder of the container into container interior 15 and can be removed in the reverse manner. In such arrangement, cover 14 is not articulated in a pivotable manner to the container body, but rather is mounted in such a manner that it can be raised and lowered vertically with respect to the container. Any locking mechanisms necessary for a sealed closure of fill opening 4 and outlet opening 5 by means of cover 14 and bottom cover 11 would be understood by those skilled in the art and therefore are not illustrated in the drawings.

It is possible, during the drying and/or preheating of the coal to a temperature of approximately 250° C., and during the coking step at a temperature range above 600° C. to approximately 1300° C., to use direct or indirect heating or combinations thereof without any problems. Similarly, the dry coke cooling step can be achieved by the above direct and/or indirect heat transfer methods. However, it is necessary that the heat exchange operation is achieved only indirectly during coking in a temperature range between approximately 250° and 600° C., in order not to disturb the transitional phase from finely granulated coal into lump coke. Those skilled in the art will understand that such finely granulated coal is employed for the formation of coke and that during the initial coking stage such coal forms so-called lump coke. Indirect heat exchange must be employed so as not to disrupt the transitional phase between the fine-grained coal pile and the lump coke as a result of the plastic phase which occurs in this temperature range and the lack of interstitial space, which factors would not allow a uniform gas flow through the coke pile.

Preferably a gas which is inert with respect to the coal is used both in the direct and in the indirect heating and cooling steps. This of course is an obvious requirement during direct heat exchange. However, the use of an inert gas in indirect heat transfer, wherein the gases do not come into direct contact with the coal and/or coke, likewise is advantageous in order to prevent danger from leakages which might occur in the piping system.

Figure 2:
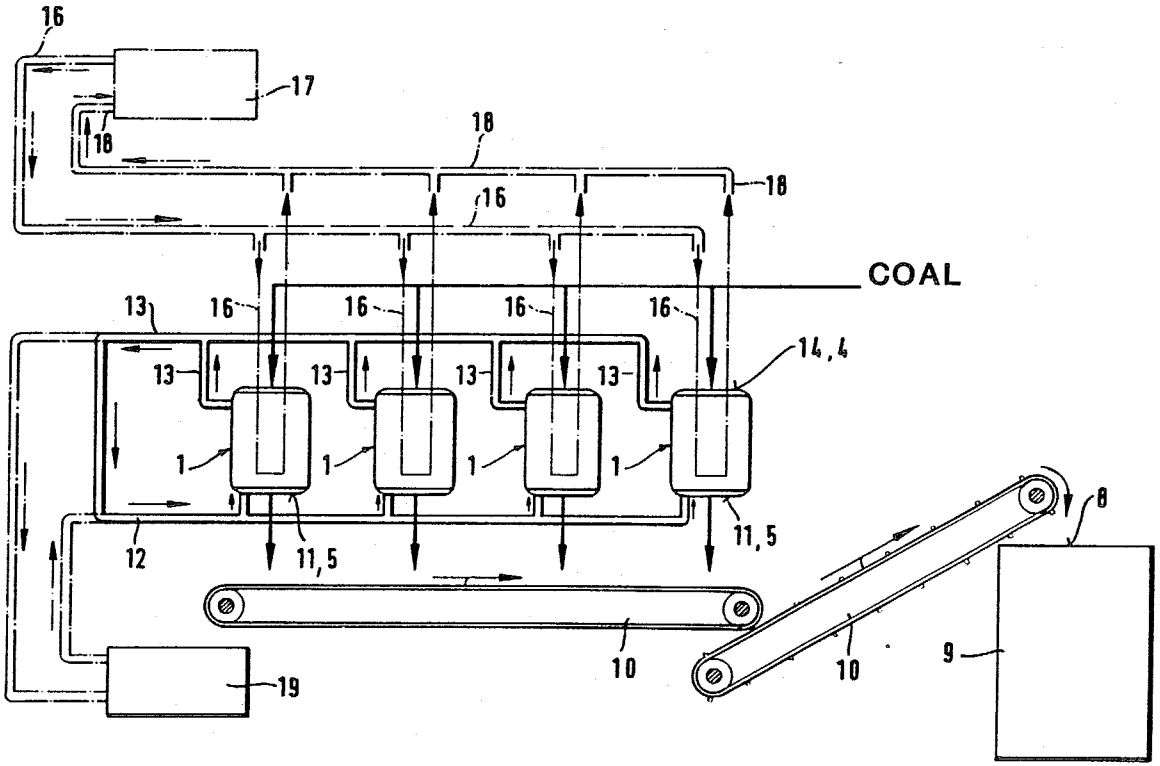
FIG. 2 is a schematic view of an installation in accordance with one embodiment of the present invention and employing a plurality of containers of the type shown in FIG. 1 for carrying out the methods of the present invention.

FIG. 2 illustrates one example of how several containers 1 of the type shown in FIG. 1 can be used in an overall installation. Containers 1 have a size and weight such that they can be transported and are located in the illustrated arrangement adjacent to each other over a horizontal section of a conveyor system. While the production of coke takes place in one particular container 1, for example by drying, preheating, coking and optional dry coking, finished refined coke from another container 1 may be discharged downwardly onto conveyor system 10 by opening the respective bottom cover 11. The cperations in the various individual containers 1 can be staggered in time, for example, so that finished coke may be supplied relatively evenly to the consumer or receiver position, in FIG. 2 illustrated as a blast furnace 9 with an upper filling opening 8 located adjacent an upwardly moving section of conveyor system 10.

It also is possible to construct and arrange containers 1 to themselves be transportable, e.g. self-transportatable, whereby it is possible to transport a particular container 1 containing finished coke to a position over fill opening 8 of the blast furnace, whereupon the coke can be delivered to fill opening 8 either by opening bottom cover 11 or by tipping the container to discharge the finished coke through upper fill opening 4 into opening 8 of the receiver position. In such an arrangement conveyor system 10 would not be necessary, but means for transporting and/or tipping containers 1 would be provided. Those skilled in the art readily would understand the construction and types of devices which could be employed for achieving such transportation and tipping. In the arrangement illustrated in FIG. 2, containers 1 remain stationary, and the particular processing gases for achieving the drying and/or preheating and/or coking and/or dry coke cooling operations are supplied to the respective containers successively in time. However, it also is possible that the individual containers 1 can move in succession through a plurality of processing stations, for example four such stations, whereby drying occurs at a first station, preheating at a second station, coking at a third station and dry coke cooling at a fourth station. Also, it obviously is possible, for example, to combine the various stages, for example to combine the stages of drying and preheating in one station or to perform only one processing stage, for example dry coke cooling at one station and all other operations at another, common station. The supply of the various treatment gases at such stations then would be achieved in a manner which would be apparent to one skilled in the art. The various treatment gases may be supplied with advantage according to the invention via lines 18 in a closed circuit of a known high temperature reactor 17 which furnishes inert gases at the required temperature for a particular processing stage, i.e. cools or heats a particular gas as required for a particular stage. Additional heating or cooling devices, for example one or more adjacent containers, also can be connected into the closed circuit. Inert gases at appropriate temperatures for heat transfer also can be furnished from a separate inert gas source 19, with which necessary heating and/or cooling devices are associated.

While the present invention has been described and illustrated with respect to preferred features thereof, various modifications and changes to the specifically described and illustrated features may be made without departing from the scope of the present invention. It particularly is contemplated that all described and/or illustrated features may be employed individually or in any possible combination, as would be apparent to one skilled in the art.

We claim:

1. A method of producing coke from coal, said method comprising:

introducing coal to be coked into a pressure sealed container;

conducting a gas through said container in direct and/or indirect heat exchange with said coal and thereby heating said coal to a temperature of approximately 250° C.;

thereafter conducting a gas through said container in indirect heat exchange only with said coal and thereby heating said coal from a temperature of approximately 250° C. to a temperature of approximately 600° C. at which lump coke is formed; and thereafter conducting a gas through said container in direct and/or indirect heat exchange with said lump coke and thereby heating said lump coke from a temperature of approximately 600° C. to a temperature between approximately 1100° and 133° C., thereby forming refined coke.

2. A method as claimed in claim 1, wherein said heating said coal to a temperature of approximately 250° C. comprises conducting said gas through container in indirect heat exchange with said coal.

3. A method as claimed in claim 1, wherein said heating said coal to a temperature of approximately 250° C. comprises conducting said gas through said container in direct heat exchange with said coal, and said gas in an inert gas.

4. A method as claimed in claim 1, wherein said heating said coal to a temperature of approximately 250° C. comprises conducting said gas through said container in both direct and indirect heat exchange with said coal, and at least said gas in direct heat exchange with said coal is an inert gas.

5. A method as claimed in claim 1, wherein said forming said refined coke comprises conducting said gas through said container in indirect heat exchange with said lump coke.

6. A method as claimed in claim 1, wherein said forming said refined coke comprises conducting said gas through said container in direct heat exchange with said lump coke, and said gas is an inert gas.

7. A method as claimed in claim 1, wherein said forming said refined coke comprises conducting said gas through said container in both direct and indirect heat exchange with said lump coke, and at least said gas in direct heat exchange with said lump coke is inert gas.

8. A method as claimed in claim 1, further comprising dry cooling said refined coke by conducting a gas through said container in direct and/or indirect heat exchange with said refined coke.

9. A method as claimed in claim 1, comprising performing at least one of said heating operations by conducting inert gas through a closed circuit and therein heating said inert gas to a temperature required for performing said at least one heating operation.

10. A method as claimed in claim 1, further comprising discharging said refined coke from said container to a position of utilization.

11. A method as claimed in claim 10, wherein said discharging comprises tipping said container and discharging said refined coke through an upper filing opening thereof.

12. A method as claimed in claim 10, wherein said discharging comprises emptying said refined coke through a closable outlet opening in the bottom of said container.

13. A method as claimed in claim 1, wherein at least one said gas is introduced into said container through inlet openings provided therein.

14. A method as claimed in claim 1, wherein at least one said gas is introduced into said container through pipes extending into said container.

15. A method as claimed in claim 1, further comprising providing a plurality of said containers, passing inert gas in series through said plurality of containers, and employing said inert gas from at least one upstream said container as a processing gas to perform at least one of said heating operations in at least one downstream said container.

* * * * *